US009482248B2

(12) United States Patent
Ma et al.

(10) Patent No.: US 9,482,248 B2
(45) Date of Patent: Nov. 1, 2016

(54) ENERGY REGENERATION TYPE FORKLIFT HYDRAULIC SYSTEM

(71) Applicant: ANHUI HELI CO., LTD, Hefei, Anhui (CN)

(72) Inventors: Qingfeng Ma, Hefei (CN); Yueqing Wen, Hefei (CN); Yuan Tian, Hefei (CN); Li Zhang, Hefei (CN); Qiqi Zhou, Hefei (CN); Tianfu Wu, Hefei (CN)

(73) Assignee: ANHUI HELI CO., LTD, Hefei, Anhui (CN)

( * ) Notice: Subject to any disclaimer, the term of this patent is extended or adjusted under 35 U.S.C. 154(b) by 248 days.

(21) Appl. No.: 14/387,832

(22) PCT Filed: Feb. 25, 2013

(86) PCT No.: PCT/CN2013/071819
§ 371 (c)(1),
(2) Date: Sep. 24, 2014

(87) PCT Pub. No.: WO2013/159590
PCT Pub. Date: Oct. 31, 2013

(65) Prior Publication Data

US 2015/0082783 A1 Mar. 26, 2015

(30) Foreign Application Priority Data

Apr. 28, 2012 (CN) ..... 2012 1 0128114

(51) Int. Cl.
*F16D 31/02* (2006.01)
*F15B 21/14* (2006.01)
*B66F 9/22* (2006.01)

(52) U.S. Cl.
CPC *F15B 21/14* (2013.01); *B66F 9/22* (2013.01)

(58) Field of Classification Search
CPC ..... F15B 11/161; B66F 9/22
USPC ..... 60/414, 420
See application file for complete search history.

(56) References Cited

U.S. PATENT DOCUMENTS

| | | | |
|---|---|---|---|
| 5,505,043 | A | 4/1996 | Baginski et al. |
| 2001/0030085 | A1 | 10/2001 | Nagata et al. |
| 2006/0233633 | A1 | 10/2006 | Passeri |

FOREIGN PATENT DOCUMENTS

| | | | |
|---|---|---|---|
| CN | 201169289 | Y | 12/2008 |
| CN | 201545673 | U | 8/2010 |

(Continued)

OTHER PUBLICATIONS

European Search Report dated Nov. 10, 2015 as received in Application No. EP 13781019.8.

(Continued)

*Primary Examiner* — Thomas E Lazo
*Assistant Examiner* — Daniel Collins
(74) *Attorney, Agent, or Firm* — Maschoff Brennan

(57) ABSTRACT

An energy regeneration type forklift hydraulic system is provided, which includes a first oil pump, a first electrical motor, a multiple directional control valve, a lifting oil cylinder, a tilting oil cylinder, a steering oil cylinder, a load-sensing steering device, an oil filter, a second oil pump and an oil tank, wherein the multiple directional control valve includes an oil inletting and returning valve spool, a raising and lowering reversing valve spool, a tilting reversing valve spool, and an oil inletting valve spool. The raising and lowering reversing valve spool includes a raising and lowering three-position six-way reversing valve, an annular oil returning passage and an oil returning passage. The system can utilize the potential energy of lowering cargo to simultaneously drive two oil pumps for driving two motors to generate energy, thereby realizing energy recovery.

1 Claim, 2 Drawing Sheets

(56) References Cited

FOREIGN PATENT DOCUMENTS

| | | | |
|---|---|---|---|
| CN | 201660015 | U | 12/2010 |
| CN | 102134047 | A | 7/2011 |
| CN | 102134048 | A | 7/2011 |
| CN | 201962038 | U | 9/2011 |
| CN | 201962039 | U | 9/2011 |
| CN | 102633213 | A | 8/2012 |
| CN | 202575895 | U | 12/2012 |
| DE | 93 09 525 | U1 | 8/1993 |
| DE | 198 31 828 | A1 | 1/2000 |
| EP | 1 852 387 | A1 | 11/2007 |
| JP | 2008-087914 | A | 4/2008 |

OTHER PUBLICATIONS

First Office Action dated Jul. 3, 2013 in Application CN 201210128114.5 [Translation].

ENERGY REGENERATION TYPE FORKLIFT HYDRAULIC SYSTEM

The present application is the national phase of International Application No. PCT/CN2013/071819, titled "ENERGY REGENERATION TYPE FORKLIFT HYDRAULIC SYSTEM", filed on Feb. 25, 2013, which claims the benefit of priority to Chinese Patent Application No. 201210128114.5, entitled "ENERGY REGENERATION TYPE FORKLIFT HYDRAULIC SYSTEM", filed with the Chinese State Intellectual Property Office on Apr. 28, 2012, the entire disclosures of both applications are incorporated herein by reference.

TECHNICAL FIELD

The present application relates to the technical field of forklifts, and in particular to a forklift hydraulic system.

BACKGROUND

Forklift utilizes a lifting system to perform working procedures, such as picking up cargo, raising and lowering cargo, piling cargo and stacking cargo. After the cargo is picked up by the forklift, the forklift controls the lowering speed of the cargo by various throttling manners during the process of lowering the cargo. In this process, gravitational potential energy is totally converted into heat energy by throttle valves, which causes the temperature rise of the hydraulic system, thereby adversely affecting the reliability of the system and components and the operating efficiency of the whole forklift. With the increasingly severe shortages of international energy supply and the gradually raising awareness of environmental protection worldwide, green and energy-saving has became the future trend of technologies and products in all industries. The development makes us realize that recycling and reusing of the waste potential energy and hydraulic energy is an effective approach for energy conservation and emission reduction, and especially has a great practical significance for the forklift which performs raising and lowering actions repeatedly. A known lowering-process energy recovery system of the forklift is provided with one or two groups of external electromagnetic reversing valves to meet the requirement for switching operating oil paths during the raising and lowering processes, and generally, a single pump is used for generating electricity, thus an oil pump having a large displacement and an electric machine having a large power are required, which results in a high cost. A patent No. ZL 201120038176.8, titled "HYBRID FORKLIFT HYDRAULIC SYSTEM" and a patent No. ZL 201120038177.2, titled "ENERGY-SAVING HYDRAULIC SYSTEM OF ELECTRICAL FORKLIFT" provide the following technical solutions. A raising and lowering valve spool is further provided with a Pt port to solve the problem of the lowering oil path of the oil cylinder. A hydraulic controlled sequence valve is controlled by a pilot pressure oil path to meet the requirement for the electricity generation during the lowering process under different loads, and the electricity generation modes are determined according to the load conditions. The electricity generation is driven by a single pump, which requires an oil pump having a large displacement and an electric machine having a large power. The tilting action during the raising process is controlled by a safety valve, however the actual operating pressure in the tilting action is low, and the tilting action is frequently performed, and there is only one pressure setting, thus the system loss is great. The break system is supplied with oil by only one oil pump, which results in a high manufacturing cost. According to the technical solution of a patent No. ZL 200920200479.8, titled "HYDRAULIC SYSTEM FOR FORKLIFT", the problem, that the braking and the steering are associated, is solved by providing a priority valve and a diverting valve, however since the oil supplies for the braking and the steering are achieved by two oil pumps respectively, the two oil pumps are required to work simultaneously once the forklift starts work, which results in a great system power loss. In this technical solution, the hydraulic oil outputted by the two oil pumps flow through the priority valve and the diverting valve, respectively, and then are converged by an EF oil path, the converged oil is supplied to a raising oil cylinder and a tilting oil cylinder for achieving the raising and tilting of a cargo fork. However, in practice operation of the forklift, the raising operation requires a large oil flow, but the tilting operation requires less oil flow, thus the oil supply with two pumps requires to provide throttling holes in a multiple directional control valve or a pipeline to control the speed of forward tilting or backward tilting, which results in a great pressure loss and a great temperature rise of the hydraulic system.

SUMMARY

In view of the above problems, an energy regeneration type forklift hydraulic system is provided according to the present application, which has a simple structure and a low manufacturing cost, is easy to operate and meets the requirement of energy conservation and environmental protection of a forklift.

The present application provides the following technical solutions.

An energy regeneration type forklift hydraulic system, includes a first oil pump 2, a first electric machine 3, a multiple directional control valve 4, a raising and lowering oil cylinder 10, a tilting oil cylinder 11, a steering oil cylinder 12, a load-sensing steering device 13, an oil filter 18, a second oil pump 19, and an oil tank 22; the multiple directional control valve 4 is a sectional multiple directional control valve, which includes an oil inletting and returning valve spool 5, a raising and lowering reversing valve spool 6, a tilting reversing valve spool 7, and an oil inletting valve spool 8; the oil inletting and returning valve spool 5 is provided with a check valve 51 and a main safety valve 52; the raising and lowering reversing valve spool 6 includes a raising and lowering three-position six-way reversing valve, an annular oil returning passage 15 and an oil returning passage 16, and the three-position six-way reversing valve is provided with a raising and lowering median-position passage 61, a right-position oil passage 62 and a left-position oil passage 63; the tilting reversing valve 7 includes a tilting three-position six-way reversing valve, a first overload oil supplement valve 72 and a second overload oil supplement valve 73, and the three-position six-way reversing valve is provided with a tilting median-position oil passage 71; the oil inletting valve spool 8 includes a diverting valve 81, a priority valve 83 and a steering safety valve 82; the first oil pump 2 has an oil suction port in communication with the hydraulic oil tank 22 via the first check valve 1, and an oil outlet in communication with an oil inlet P1 of the oil inletting and returning valve spool 5, and after passing through the check valve 51 of the oil inletting and returning valve spool 5, the oil passage is divided into two passages, and one of the two passages is connected to an oil inlet of the raising and lowering reversing valve spool 6 and is in communication with the annular oil returning passage 15 via the raising and lowering median-position oil passage 61 and the oil returning passage 16 of the raising and lowering reversing valve spool; and the other passage is connected to an inlet of the main safety valve 52, and an outlet of the main safety valve 52 is in communication with the annular oil returning passage 15; the raising and lowering reversing valve spool 6 has a raising and lowering first oil outlet A1 connected to the raising and lowering oil cylinder 10 via a three-way pipe; the right-position oil passage 62 of the raising and lowering three-position six-way reversing valve is in communication with a raising and lowering oil inlet and the raising and lowering first oil outlet A1; the left-position oil passage 63 of the raising and lowering three-position six-way reversing valve is in communication with the raising and lowering first oil outlet A1 and a raising and lowering second oil outlet B1; the second oil pump 19 has an oil suction port in communication with the hydraulic oil tank 22 via a check valve 21, and an oil outlet in communication with an inlet of the diverting valve 81 via an oil inlet P2 of the oil inletting valve spool 8; the diverting valve 81 has a first oil outlet BF in communication with a braking system, and a second oil outlet in communication with an inlet of the priority valve 83; the priority valve 83 is in communication with a signal port LS of the load-sensing steering device 13 via an LS signal oil path 14; the priority valve 83 has a first oil outlet CF in communication with an oil inlet P of the load-sensing steering device 13, and a second oil outlet EF in communication with a three-way pipe; the three-way pipe has a first oil outlet in communication with an oil inlet of the tilting reversing valve spool 7, and a second oil outlet in communication with the tilting median-position oil passage 71, and the second oil outlet of the three-way pipe is further in communication with the oil inlet of the raising and lowering reversing valve spool 6 via the tilting median-position oil passage 71 and is in turn in communication with the annular oil returning passage 15 via the raising and lowering median-position oil passage 61 and the oil returning passage 16 of the raising and lowering reserving valve spool; the steering safety valve 82 has an oil inlet in communication with the LS signal oil path 14, and an oil outlet in communication with the annular oil returning passage 15; the tilting reversing valve spool 7 has a tilting first oil outlet A2 and a tilting second oil outlet B2 in communication with a rod chamber and a rodless chamber of the tilting oil cylinder 11, respectively; the first overload oil supplement valve 72 has an oil inlet in communication with the tilting first oil outlet A2, and an oil outlet in communication with the annular oil returning passage 15; the second overload oil supplement valve 73 has an oil inlet in communication with the tilting second oil outlet B2, and an oil outlet in communication with the annular oil returning passage 15; the annular oil returning passage 15 is led back to the oil tank 22 via an oil returning port T and the oil filter 18, and wherein the raising and lowering second oil outlet B1 of the raising and lowering reversing valve spool 6 is in communication with the oil suction port of the first oil pump 2 and the oil suction port of the second oil pump 19, respectively, via a four-way pipe 9; and the oil suction port of the first oil pump 2 is in communication with the oil tank 22 via the first check valve 1, and the oil suction port of the second oil pump 19 is in communication with the oil tank 22 via the second check valve 21.

The first oil pump 2 and the second oil pump 19 each have a pump operation condition and a motor operation condition; and the first electric machine 3 and the second electric machine 20 each have an electric motor operation condition and a generator operation condition.

Compared with the conventional products, the present application has the following advantageous.

1. The present application is adapted to an electric forklift.

2. The pressure oil outputted in the process of lowering the cargo may drive the two oil pumps to drive the two electric machines to generate electricity, thereby achieving energy recovery. Alternatively, a part of the pressure oil may be supplied to the second oil pump, and is converted into hydraulic energy required for operations of steering, braking or tilting devices, and the remaining differential pressure may also drive the electric machine to generate electricity; another part of the pressure oil drives the first oil pump to drive the electric machine to generate electricity, and the generated electrical energy is stored into an energy storage component by an inverter, thereby achieving partial recovery of potential energy. Hence, the efficiency of regeneration and recovery is high.

3. Since the system employs two oil pumps to achieve energy regeneration and recovery, compared with a case that a single pump is used for generating electricity, the displacement of the oil pump and the power of the electric machine are reduced by half, thereby reducing the cost of development.

4. With the innovative design of the oil passage in the raising and lowering three-position six-way valve of the multiple directional control valve, the reversing oil passage 63 and the port B1 are connected to the lowering electricity generation oil path. Hence, the structure is simple, and the raising action and the lowering electricity generation are both achieved by manipulating a raising and lowering valve rod manually, and no additional control element is required, thus the operation is simple and easy, and the cost is low.

5. The two hydraulic pumps may independently or jointly supply oil to the cargo loading raising system. The converging of oil is realized in the oil passages in the multiple directional control valve, and no external oil passage is required. Hence, the structure is simple and compact, and has fewer pipes, and the manufacturing cost is low. A single pump is used to supply oil to realize the tilting action of the mast, and thus there is no throttling loss, and the efficiency is high.

6. By arranging one diverting valve and one priority valve in the oil inletting valve spool of the multiple directional control valve, on one hand, the structure is compact and the pipeline arrangement is simple; and on the other hand, the actions of braking and steering may be performed by a single pump source, without causing interference, thereby avoiding the system power loss which is caused by simultaneous working of the two oil pumps due to association between the braking and the steering actions.

7. The tilting oil path has a single overload protection device, and thus has a high safety, which may avoid a large power loss caused in a case that the tilting action and the raising action are controlled by one main safety valve (the pressure of the main safety valve is set according to the operating pressure of the raising oil path), since the operating pressure of the tilting action is low and the operation is frequent.

8. In two states of raising cargo and generating electricity in lowering cargo, the rotational direction of the oil pump is constantly identical to that of the electric machine, thus the control system of the machine is simple, convenient, reliable and responsive, and the impact caused when the electric machine changes the rotational direction is avoided.

Figure 1:
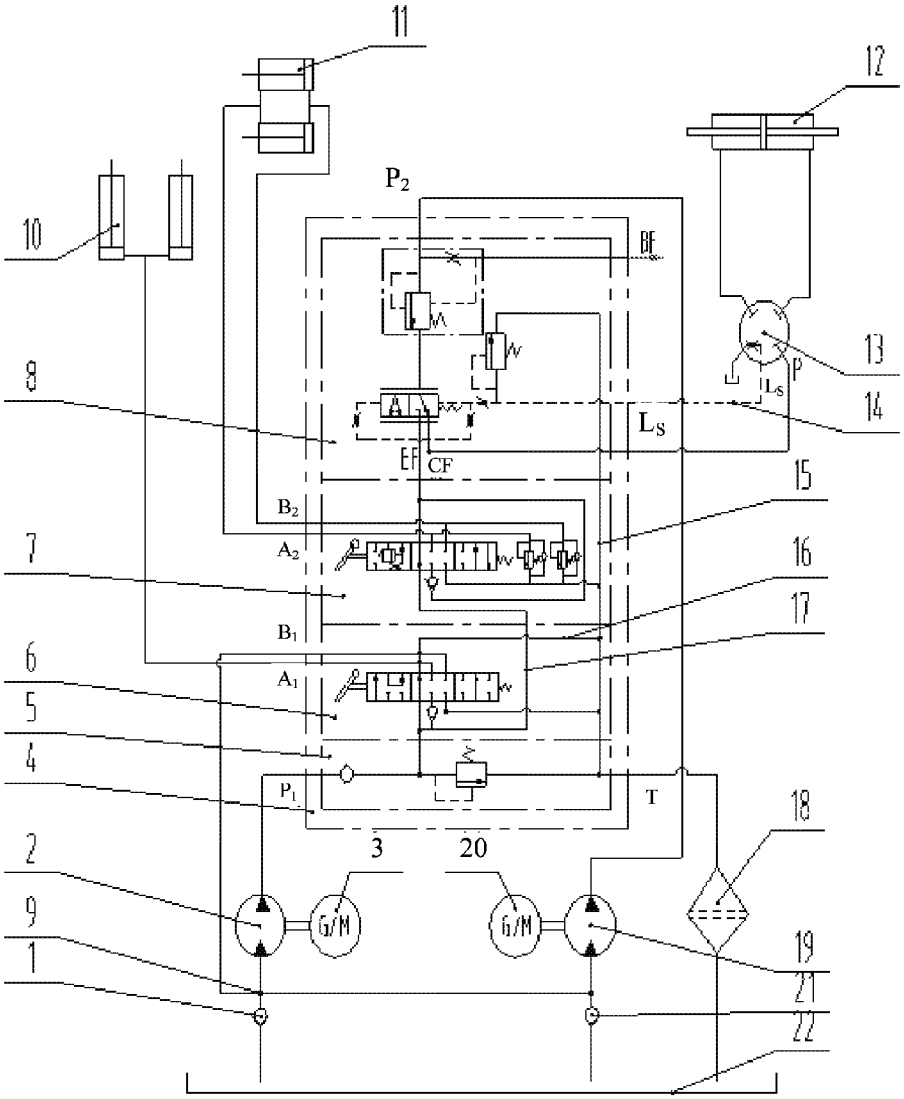
FIG. 1 is a schematic diagram of a system according to the present application.
Figure 2:
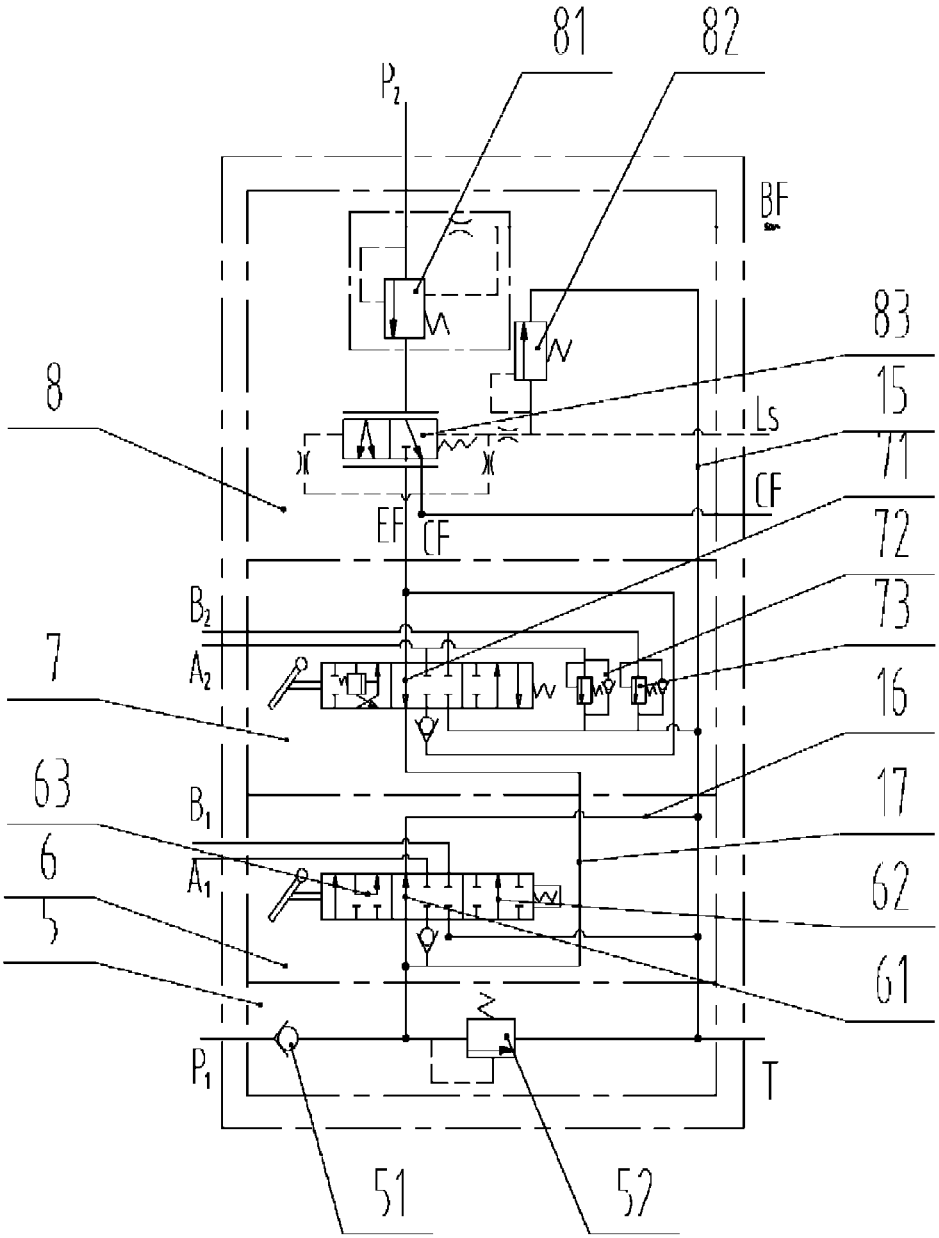
FIG. 2 is a schematic diagram of a multiple directional control valve of FIG. 1.

Reference numerals in the above Figures:

| | |
|---|---|
| 1 first check valve, | 2 first oil pump, |
| 3 first electric machine, | 4 multiple directional control valve, |
| 5 oil inletting and returning valve spool, | 51 check valve, |
| 52 main safety valve, | |
| 6 raising and lowering reversing valve spool, | |
| 61 raising and lowering middle-position passage, | |
| 62 right-position oil passage, | 63 left-position oil passage, |
| 7 tilting reversing valve spool, | 71 tilting middle-position oil passage, |
| 72 first overload oil supplement valve, | 73 second overload oil supplement valve, |
| 8 oil inletting valve spool, | 81 diverting valve, |
| 82 steering safety valve 82, | 83 priority valve, |
| 9 four-way pipe, | 10 raising and lowering oil cylinder, |
| 11 tilting oil cylinder, | 12 steering oil cylinder, |
| 13 load-sensing steering device, | 14 LS signal oil path, |
| 15 annular oil returning passage, | 16 oil returning passage, |
| 17 oil passage, | 18 oil filter, |
| 19 second oil pump, | 20 second electric machine, |
| 21 second check valve, and | 22 oil tank. |

DETAILED DESCRIPTION

The present application is further described below by embodiments in conjunction with drawings.

Embodiments:

An energy regeneration type forklift hydraulic system includes a first oil pump 2, a first electric machine 3, a multiple directional control valve 4, a raising and lowering oil cylinder 10, a tilting oil cylinder 11, a steering oil cylinder 12, a load-sensing steering device 13, an oil filter 18, a second oil pump 19, and an oil tank 22. The multiple directional control valve 4 is a sectional multiple directional control valve, which includes an oil inletting and returning valve spool 5, a raising and lowering reversing valve spool 6, a tilting reversing valve spool 7, and an oil inletting valve spool 8. The oil inletting and returning valve spool 5 is provided with a check valve 51 and a main safety valve 52. The raising and lowering reversing valve spool 6 includes a raising and lowering three-position six-way reversing valve, an annular oil returning passage 15 and an oil returning passage 16, and the three-position six-way reversing valve is provided with a raising and lowering median-position passage 61, a right-position oil passage 62 and a left-position oil passage 63. The tilting reversing valve 7 includes a tilting three-position six-way reversing valve, a first overload oil supplement valve 72 and a second overload oil supplement valve 73, and the three-position six-way reversing valve is provided with a tilting median-position oil passage 71. The oil inletting valve spool 8 includes a diverting valve 81, a priority valve 83 and a steering safety valve 82. The first oil pump 2 has an oil suction port communicated with the hydraulic oil tank 22 via the first check valve 1, and an oil outlet in communication with an oil inlet P1 of the oil inletting and returning valve spool 5, and after passing through the check valve 51 of the oil inletting and returning valve spool 5, the oil passage is divided into two passages, and one of the two passages is connected to an oil inlet of the raising and lowering reversing valve spool 6 and is in communication with the annular oil returning passage 15 via the raising and lowering median-position oil passage 61 and the oil returning passage 16 of the raising and lowering reversing valve spool, and the other passage is connected to an inlet of the main safety valve 52, and an outlet of the main safety valve 52 is in communication with the annular oil returning passage 15. The raising and lowering reversing valve spool 6 has a raising and lowering first oil outlet A1 connected to the raising and lowering oil cylinder 10 via a three-way pipe. The right-position oil passage 62 of the raising and lowering three-position six-way reversing valve is in communication with a raising and lowering oil inlet and the raising and lowering first oil outlet A1. The left-position oil passage 63 of the raising and lowering three-position six-way reversing valve is in communication with the raising and lowering first oil outlet A1 and a raising and lowering second oil outlet B1.

An oil outlet of the second oil pump 19 is in communication with an inlet of the diverting valve 81 via an oil inlet P2 of the oil inletting valve spool 8. The diverting valve 81 has a first oil outlet BF in communication with a braking system, and a second oil outlet in communication with an inlet of the priority valve 83. The priority valve 83 is in communication with a signal port LS of the load-sensing steering device 13 via an LS signal oil path 14. The priority valve 83 has a first oil outlet CF in communication with an oil inlet P of the load-sensing steering device 13, and a second oil outlet EF in communication with a three-way pipe. The three-way pipe has a first oil outlet in communication with an oil inlet of the tilting reversing valve spool 7, and a second oil outlet in communication with the tilting median-position oil passage 71, and the second oil outlet is further in communication with the oil inlet of the raising and lowering reversing valve spool 6 via the tilting median-position oil passage 71 and is in turn in communication with the annular oil returning passage 15 via the raising and lowering median-position oil passage 61 and the oil returning passage 16 of the raising and lowering reserving valve spool. The steering safety valve 82 has an oil inlet in communication with the LS signal oil path 14, and an oil outlet in communication with the annular oil returning passage 15.

The tilting reversing valve spool 7 has a tilting first oil outlet A2 and a tilting second oil outlet B2 in communication with a rod chamber and a rodless chamber of the tilting oil cylinder 11, respectively. The first overload oil supplement valve 72 has an oil inlet in communication with the tilting first oil outlet A2, and an oil outlet in communication with the annular oil returning passage 15. The second overload oil supplement valve 73 has an oil inlet in communication with the tilting second oil outlet B2, and an oil outlet in communication with the annular oil returning passage 15. The annular oil returning passage 15 is led back to the oil tank 22 via an oil returning port T and the oil filter 18. The raising and lowering second oil outlet B1 of the raising and lowering reversing valve spool 6 is in communication with the oil suction port of the first oil pump 2 and an oil suction port of the second oil pump 19, respectively, via a four-way pipe 9. The oil suction port of the first oil pump 2 is in communication with the oil tank 22 via the first check valve 1, and the oil suction port of the second oil pump 19 is in communication with the oil tank 22 via the second check valve 21.

The first oil pump 2 and the second oil pump 19 each have a pump operation condition and a motor operation condition. The first electric machine 3 and the second electric machine 20 each have an electric motor operation condition and a generator operation condition.

The operation principle of the present application is described hereinafter.

When the forklift performs a raising action to pick up cargo, the raising and lowering reversing valve spool 6 is switched to a right position and the two pumps both supply oil. The first oil pump 2 sucks oil from the oil tank 22 through the first check valve 1, the pressure oil outputted from the first oil pump 2 flows through the oil inlet P1 of the multiple directional control valve 4 and flows into the oil inlet of the raising and lowering reversing valve spool 6 through the check valve 51. The pressure oil outputted from the second oil pump 19 flows through the oil inlet P2 of the multiple directional control valve 4 and flows to the oil inlet of the raising and lowering reversing valve spool through the diverting valve 81, the priority valve 83 and the tilting reversing valve spool 7, and then the pressure oil from the second oil pump 19 and the pressure oil from the first oil pump 2 are converged at the oil inlet of the raising and lowering reversing valve spool 6. The converged pressure oil flows into the raising and lowering oil cylinder 10 through the right-position oil passage 62 and the raising and lowering first oil outlet A1 of the raising and lowering reversing valve spool 6, thereby achieving the raising action for loading the cargo. The main safety valve 52 of the oil inletting and returning valve spool 5 is configured to define the highest operating pressure of each of the first oil pump 2 and the second oil pump 19.

When the forklift loaded with the cargo performs the lowering action, the raising and lowering reversing valve spool 6 is switched to a left position. Pressure oil outputted by the raising and lowering oil cylinder 10 during the lowering process flows through the raising and lowering first oil outlet A1, the left-position oil passage 63 and the raising and lowering second oil outlet B1 of the raising and lowering reversing valve spool 6, and flows to the oil inlet of the first oil pump 2 and the oil inlet of the second oil pump 19 through the four-way pipe 9. Due to one-way stopping function of the first check valve 1 and the second check valve 21, the pressure oil from the two raising and lowering oil cylinders 10 flows into the oil inlets of the first oil pump 2 and the second oil pump 19, to drive the first oil pump 2 and the second oil pump 19 to drive the first electric machine 3 and the second electric machine 20 to rotate respectively, thereby generating electricity. The generated electrical energy is stored into a storage device by an inverter, thereby realizing the energy recovery. At this time, the first oil pump 2 and the second oil pump 19 are both under the hydraulic motor operation condition, and the first electric machine 3 and the second electric machine 20 are both under the generator operation condition. When performing actions of tilting, steering or braking in the lowering action, a part of the pressure oil outputted from the two raising and lowering oil cylinders 10 during the lowering process flows into the oil suction port of the second oil pump 19 to supply oil with pressure for the second oil pump 19, and to provide pressure and flow required in the tilting action, the steering action or the braking action through the valve port P2 of the multiple directional control valve, and at the same time, the remaining differential pressure may still drive the second electric machine 20 to generate electricity, thereby achieving partial recovery and using of the potential energy. Another part of the pressure oil flows into the oil suction portion of the first oil pump 2, and in this case, the first oil pump 2 is under the hydraulic motor operation condition and drives the first electric machine 3 to rotate for generating electricity, and the generated electrical energy is stored in an electric energy storing component by an inverter, thereby achieving partial recovery of the potential energy.

When the forklift is required to perform the braking action, the steering action or the tilting action in a case that the raising action is not performed, the first oil pump 2 does not work. The pressure oil outputted from the second oil pump 19 flows through the valve port P2 of the multiple directional control valve and the diverting valve 81 and then is supplied to the braking system via the port BF of the diverting valve 81 at a steady flow, thereby meeting the requirement for the braking oil resource. The excess oil flows into the priority valve 83. If no steering action is performed, the port LS of the load-sensing steering device 13 feedbacks the signal, which indicates that the pressure is almost zero, to the priority valve 83 via the LS signal oil path 14. At this time, besides that the oil flowing in the signal oil path at the flow rate of 0.5 to 1 L/min flows back to the oil tank, most of the oil flows into the oil inlet of the tilting reversing valve spool 7 of the multiple directional control valve through the second oil outlet EF of the priority valve 83, thereby achieving the forward and rearward tilting action of the forklift mast and improving the efficiency of the system. When performing the steering action, the port LS of the load-sensing steering device 13 transmits a steering pressure signal to the priority valve 83 via the LS signal oil path 14 in real time. According to the feedback signal, the priority valve 83 supplies the required amount of oil to the load-sensing steering device 13 through the first oil outlet CF to drive the steering oil cylinder 12, thereby achieving the steering of the body of the forklift The excess oil flows into the tilting reversing valve spool 7 of the multiple directional control valve through the second oil outlet EF of the priority valve 83, thereby achieving the forward and rearward tilting action of the forklift mast. The first overload oil supplement valve 72 arranged in the tilting reversing valve spool 72 has two functions, one function is to define the highest pressure of the rod chamber of the tilting oil cylinder, and the other function is to avoid a vacuum phenomenon caused by a too fast backward tilting action of the tilting oil cylinder when the mast is at a high picking position, so as to achieve oil supplement. The second overload oil supplement valve 73 arranged in the tilting reversing valve spool 7 also has two functions, one function is to define the highest pressure of the rodless chamber of the tilting oil cylinder, and the other function is to prevent a vacuum phenomenon caused by a too fast forward tilting action of the tilting oil cylinder, so as to achieve oil supplement.

When the forklift performs the tilting action or the steering action while performing the raising action, the pressure oil outputted from the first oil pump 2 is only used for the raising action, and the pressure oil outputted from the second oil pump 19 is used for the tilting action, the braking action or the steering action, and thus there are no interference between these actions.

If neither the raising action nor the tilting action (or the braking action, the steering action) is performed, neither of the first oil pump 2 and the second oil pump 19 works.

The invention claimed:

1. An energy regeneration type forklift hydraulic system, comprising a first oil pump (2), a first electric machine (3), a multiple directional control valve (4), a raising and lowering oil cylinder (10), a tilting oil cylinder (11), a steering oil cylinder (12), a load-sensing steering device (13), an oil filter 18, a second oil pump (19), and an oil tank (22); the multiple directional control valve (4) is a sectional multiple directional control valve, which comprises an oil inletting and returning valve spool (5), a raising and lowering reversing valve spool (6), a tilting reversing valve spool (7), and an oil inletting valve spool (8); the oil inletting and returning valve spool (5) is provided with a check valve (51) and a main safety valve (52); the raising and lowering reversing valve spool (6) comprises a raising and lowering three-position six-way reversing valve, an annular oil returning passage (15) and an oil returning passage (16), and the three-position six-way reversing valve is provided with a raising and lowering median-position passage (61), a right-position oil passage (62) and a left-position oil passage (63); the tilting reversing valve (7) comprises a tilting three-position six-way reversing valve, a first overload oil supplement valve (72) and a second overload oil supplement valve (73), and the three-position six-way reversing valve is provided with a tilting median-position oil passage (71); the oil inletting valve spool (8) comprises a diverting valve (81), a priority valve (83) and a steering safety valve (82); the first oil pump (2) has an oil suction port in communication with the hydraulic oil tank (22) via the first check valve (1), and an oil outlet in communication with an oil inlet P1 of the oil inletting and returning valve spool (5), and after passing through the check valve (51) of the oil inletting and returning valve spool (5), the oil passage is divided into two passages, and one of the two passages is connected to an oil inlet of the raising and lowering reversing valve spool (6) and is in communication with the annular oil returning passage (15) via the raising and lowering median-position oil passage (61) and the oil returning passage (16) of the raising and lowering reversing valve spool; and the other passage is connected to an inlet of the main safety valve (52), and an outlet of the main safety valve (52) is in communication with the annular oil returning passage (15); the raising and lowering reversing valve spool (6) has a raising and lowering first oil outlet A1 connected to the raising and lowering oil cylinder (10) via a three-way pipe; the right-position oil passage (62) of the raising and lowering three-position six-way reversing valve is in communication with a raising and lowering oil inlet and the raising and lowering first oil outlet A1; the left-position oil passage (63) of the raising and lowering three-position six-way reversing valve is in communication with the raising and lowering first oil outlet A1 and a raising and lowering second oil outlet B1; the second oil pump (19) has an oil suction port in communication with the hydraulic oil tank (22) via a check valve (21), and an oil outlet in communication with an inlet of the diverting valve (81) via an oil inlet P2 of the oil inletting valve spool (8); the diverting valve (81) has a first oil outlet BF in communication with a braking system, and a second oil outlet in communication with an inlet of the priority valve (83); the priority valve (83) is in communication with a signal port LS of the load-sensing steering device (13) via an LS signal oil path (14); the priority valve (83) has a first oil outlet CF in communication with an oil inlet P of the load-sensing steering device (13), and a second oil outlet EF in communication with a three-way pipe; the three-way pipe has a first oil outlet in communication with an oil inlet of the tilting reversing valve spool (7), and a second oil outlet in communication with the tilting median-position oil passage (71), and the second oil outlet of the three-way pipe is further in communication with the oil inlet of the raising and lowering reversing valve spool (6) via the tilting median-position oil passage (71) and is in turn in communication with the annular oil returning passage (15) via the raising and lowering median-position oil passage (61) and the oil returning passage (16) of the raising and lowering reserving valve spool; the steering safety valve (82) has an oil inlet in communication with the LS signal oil path (14), and an oil outlet in communication with the annular oil returning passage (15); the tilting reversing valve spool (7) has a tilting first oil outlet A2 and a tilting second oil outlet B2 in communication with a rod chamber and a rodless chamber of the tilting oil cylinder (11), respectively; the first overload oil supplement valve (72) has an oil inlet in communication with the tilting first oil outlet A2, and an oil outlet in communication with the annular oil returning passage (15); the second overload oil supplement valve (73) has an oil inlet in communication with the tilting second oil outlet B2, and an oil outlet in communication with the annular oil returning passage (15); the annular oil returning passage (15) is led back to the oil tank (22) via an oil returning port T and the oil filter (18), and wherein the raising and lowering second oil outlet B1 of the raising and lowering reversing valve spool (6) is in communication with the oil suction port of the first oil pump (2) and the oil suction port of the second oil pump (19), respectively, via a four-way pipe (9); and the oil suction port of the first oil pump (2) is in communication with the oil tank (22) via the first check valve (1), and the oil suction port of the second oil pump (19) is in communication with the oil tank (22) via the second check valve (21); and the first oil pump (2) and the second oil pump (19) each have a pump operation condition and a motor operation condition; and the first electric machine (3) and the second electric machine (20) each have an electric motor operation condition and a generator operation condition.

* * * * *